US008521059B2

(12) United States Patent
Furuya et al.

(10) Patent No.: US 8,521,059 B2
(45) Date of Patent: Aug. 27, 2013

(54) APPARATUS TRANSPORTABLE IN A CARTRIDGE-MOUNTED STATE FOR ELECTROPHOTOGRAPHY IMAGE FORMING

(75) Inventors: Norio Furuya, Numazu (JP); Wataru Uchida, Mishima (JP); Takeshi Niimura, Yokohama (JP); Yusuke Niikawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 326 days.

(21) Appl. No.: 13/005,437

(22) Filed: Jan. 12, 2011

(65) Prior Publication Data

US 2011/0170905 A1 Jul. 14, 2011

(30) Foreign Application Priority Data

Jan. 14, 2010 (JP) ..... 2010-005835
Dec. 16, 2010 (JP) ..... 2010-281047

(51) Int. Cl.
*G03G 21/16* (2006.01)

(52) U.S. Cl.
USPC ..... 399/111

(58) Field of Classification Search
USPC ..... 399/107–114
See application file for complete search history.

(56) References Cited

U.S. PATENT DOCUMENTS 7,340,197 B2 * 3/2008 Murayama et al. ..... 399/111
8,135,304 B2 * 3/2012 Abe et al. ..... 399/111
8,249,485 B2 * 8/2012 Horikawa et al. ..... 399/111

FOREIGN PATENT DOCUMENTS

JP 2006-071671 A 3/2006

* cited by examiner

*Primary Examiner* — Hoan Tran
(74) *Attorney, Agent, or Firm* — Canon USA Inc. IP Division

(57) ABSTRACT

An inexpensive and stable regulating member which can control, without depending on an open/close cover, movement of a cartridge used for an image forming apparatus transportable in a cartridge-mounted state is provided. The regulating member includes a first contact portion which receives a first force applied from the cartridge to inside of the regulating member and a second contact portion which receives a second force that prevents the regulating member from moving from a regulating position by receiving the first force at a position away from a mounting and dismounting path of the cartridge where the cartridge passes when the cartridge is mounted on or dismounted from the apparatus main body.

12 Claims, 11 Drawing Sheets

APPARATUS TRANSPORTABLE IN A CARTRIDGE-MOUNTED STATE FOR ELECTROPHOTOGRAPHY IMAGE FORMING

BACKGROUND OF THE INVENTION

1. Field of the Invention

The present invention relates to an image forming apparatus transportable in a cartridge-mounted state. The image forming apparatus is an apparatus used for forming an image on a recording medium. The image forming apparatus may include, for example, an electrophotographic copying machine, an electrophotographic printer (e.g., a laser printer or alight emitting diode (LED) printer), a facsimile apparatus, or a multifunction peripheral (e.g., multifunction printer).

2. Description of the Related Art

Image forming apparatuses form an image on a recording material according to electrophotography image forming processes using an electrophotography photosensitive member and a transfer member. In order to enhance usability, a cartridge that integrates a photosensitive member and a process unit that acts on the photosensitive member and is removable from the apparatus main body is widely used in a configuration of an image forming unit. Further, in recent years, in order to improve efficiency of transportation by downsizing, the cartridge has been mounted to and integrated into the product main body and the apparatus is shipped in that state.

In such a case, the cartridge may move from its mounting position in the apparatus main body due to vibration and impact during carriage and transportation, and the cartridge or a part of the apparatus main body may be damaged. According to Japanese Patent Application Laid-Open No. 2006-71671, a regulating member is provided on a mounting and dismounting path of a cartridge to the apparatus main body between the cartridge and an open/close cover. According to the regulating member, the movement of the cartridge during the transportation and carriage of the image forming apparatus has been controlled. Only the cartridge is mounted on the apparatus main body. Before the image forming apparatus is transported, the regulating member is set so that it contacts the cartridge. Since the regulating member is pressed by the open/close cover, the cartridge is secured.

Generally, the mounting path of the cartridge is approximately straight from the viewpoint of facilitation of mounting and dismounting the cartridge. According to a conventional example, a regulating member is provided between the open/close cover and the cartridge. Thus, a space for the regulating member is necessary between the open/close cover and the cartridge. The space for the regulating member affects the size of the apparatus main body.

Further, the impact that is received by the cartridge is transmitted to the open/close cover via the regulating member. Thus, the open/close cover needs to be firmly secured in a closed state so that it does not open. However, if a lock mechanism or a tape is added for such a purpose, the number of necessary components will be increased and, further, the size of the apparatus main body may be increased.

Furthermore, if the open/close cover is not rigid enough, the cartridge and the regulating member may move and receive impact while the apparatus is transported. However, if a rib is added to the open/close cover or the cover is thickened so as to enhance rigidity of the open/close cover, the cost of the apparatus will be increased.

The entire product main body can be additionally secured by packing it with a packaging material so that the open/close cover is not opened or bent. In this case, the packaging material needs to have enough strength so that it is not deformed. However, if the thickness of the packaging material is increased so as to increase its strength, the size of the apparatus after the packaging will be increased.

Further, like the multifunction peripheral, if the apparatus can add an option unit to an upside of the open/close cover, for example, a part of the packaging material may be inserted between the open/close cover and the option unit. However, in this case, since the open/close cover is held only by a part of the packaging material, it is difficult to sufficiently secure the strength of that portion.

SUMMARY OF THE INVENTION

The present invention is directed to an image forming apparatus which can be transported with stability in a cartridge-mounted state without increasing a size of the apparatus main body or a regulating member.

According to an aspect of the present invention, an image forming apparatus which can be transported with a cartridge mounted, the image forming apparatus includes a mounting portion on which the cartridge is removably mounted, a regulating member configured to regulate movement of the cartridge from the mounting portion and mounted between the cartridge and an apparatus main body of the image forming apparatus, wherein the regulating member includes a first contact portion which receives a first force applied from the cartridge to inside of the regulating member if the cartridge moves from the mounting portion and a second contact portion which receives a second force that prevents the regulating member from moving to an upstream side in a mounting direction of the regulating member at a position away from a mounting and dismounting path of the cartridge where the cartridge passes when the cartridge is mounted on or dismounted from the apparatus main body by receiving the first force, and a main body regulating portion configured to regulate movement of the regulating member to a downstream side in the mounting direction by the second force and brought into contact with the regulating member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A first exemplary embodiment of the present invention will be described. Dimensions, materials, and shapes of the components described in the following exemplary embodiments and their relative arrangements are changed as appropriate according to the configuration and various conditions of the apparatus of the present invention, and thus shall not be construed as limiting the present invention unless otherwise specified.

(Image Forming Apparatus)

Figure 1:
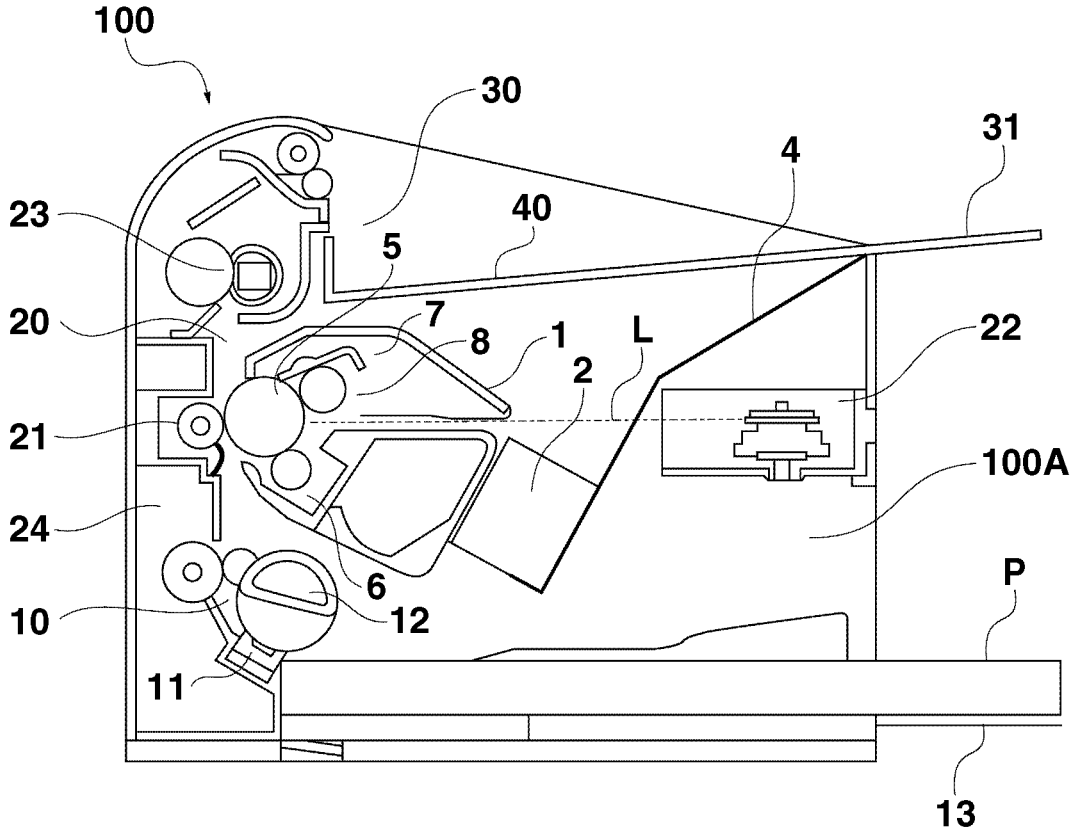
FIG. 1 is a cross-sectional view of an image forming apparatus according to a first exemplary embodiment of the present invention.

First, an electrophotography image forming apparatus (hereinafter referred to as an image forming apparatus) 100 will be described with reference to FIGS. 1 to 3. According to the present exemplary embodiment, a laser beam printer whose process cartridge (hereinafter referred to as a cartridge) is removable is taken as an example of the image forming apparatus. Further, the printer main body is packaged in an individual packaging box in a cartridge-mounted state and carried and transported to the site of an end user.

First, an outline of the configuration of the image forming apparatus will be described. FIG. 1 is a main cross-sectional view of the configuration of the image forming apparatus 100. As illustrated in FIG. 1, the image forming apparatus 100 includes a sheet feeding unit 10, an image forming unit 20, and a sheet discharge unit 30. The image forming unit 20 includes a cartridge 1, a transfer roller 21, a laser exposure unit 22, and a fixing unit 23. The fixing unit is a thermal-heating type unit. The cartridge 1 includes a photosensitive drum 5. When a laser beam L is emitted from the laser exposure unit 22, an electrostatic latent image is formed on the photosensitive drum 5. Additionally, as a process unit that acts on the photosensitive drum 5, the cartridge 1 includes a developing unit 6 that develops the electrostatic latent image, a cleaning unit 7 that removes developer from the photosensitive drum 5, and a charge unit 8 by which the photosensitive drum 5 is charged.

The sheet feeding unit 10 includes a sheet feeding roller 12 and a separation pad 11 by which recording materials P set on a tray 13 is separated and fed one sheet after another. Then, at the image forming unit 20, a toner image formed on the photosensitive drum 5 is transferred onto the recording material P, which is fed by the sheet feeding unit 10, by the transfer roller 21. Subsequently, the image is thermally-fixed by the fixing unit 23 and discharged to the sheet discharge unit 30.

Figure 2A:
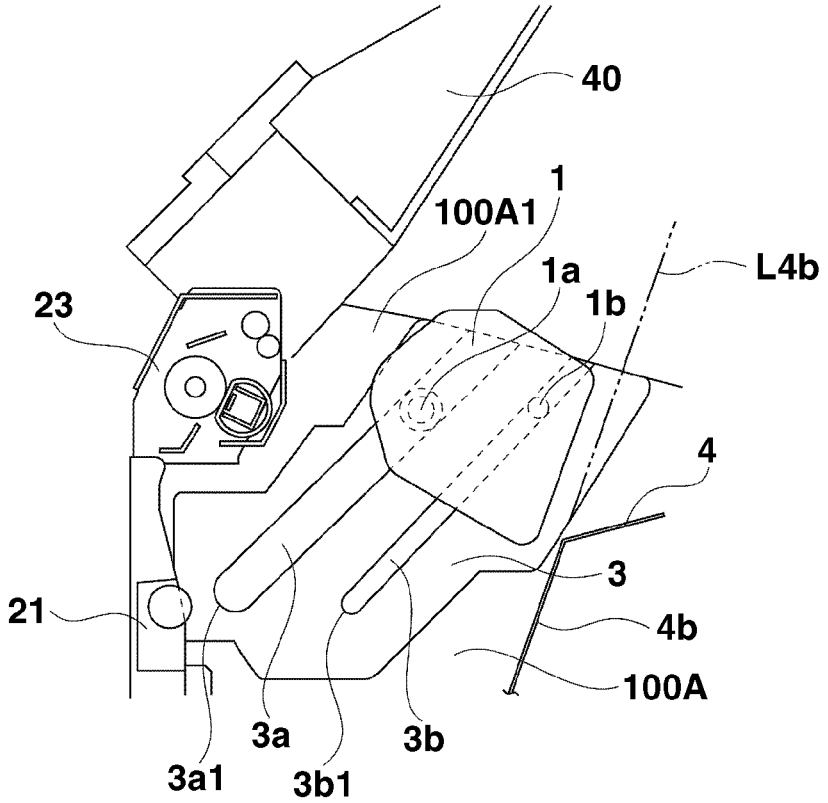
FIGS. 2A and 2B are cross-sectional views of the image forming apparatus according to the first exemplary embodiment of the present invention.
Figure 2B:
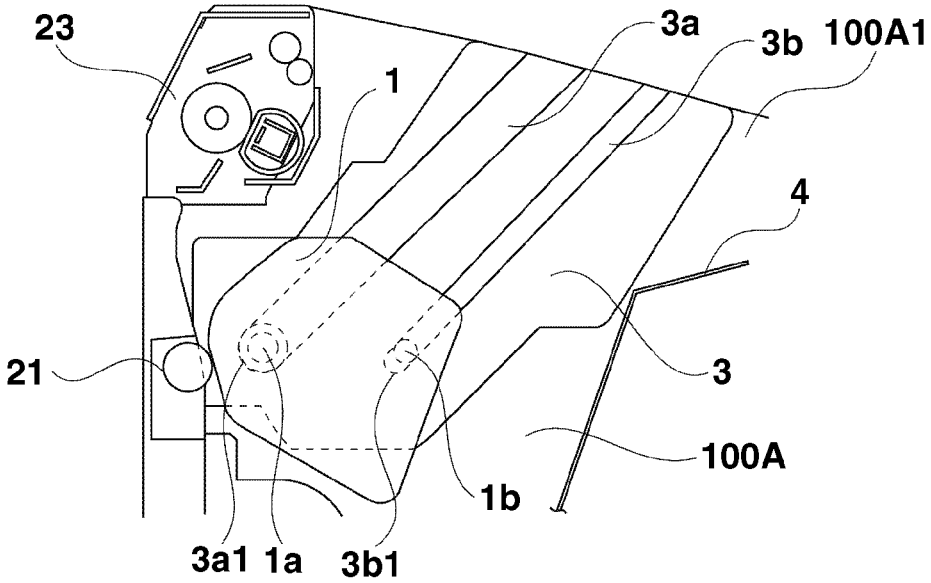

FIGS. 2A and 2B are cross-sectional views of the cartridge 1 in the vicinity of its mounting portion taken by viewing the image forming apparatus 100 from the longitudinal direction of the cartridge 1. The cross section illustrates a vertical plane passing through the center of the main body with respect to the longitudinal direction of the cartridge 1. FIG. 2A is a cross-sectional view when the mounting of the cartridge 1 into an apparatus main body 100A is started. FIG. 2B is a view when the mounting of the cartridge 1 into the apparatus main body 100A is completed.

As illustrated in FIG. 2A, when the cartridge 1 is mounted or dismounted, an open/close cover 40 is moved upward so that an opening 100A1 of the apparatus main body 100A is opened. Then, the cartridge 1 is inserted into the apparatus main body 100A from the opening 100A1. A boss 1*a* and a boss 1*b* are provided on both ends of the cartridge 1 in the longitudinal direction. The boss 1*a* is a positioning member used for determining the orientation of the cartridge 1 in the apparatus main body 100A. The boss 1*b* is a rotation control member.

Further, a mounting portion 3*a*1 which engages with the boss 1*a* and a main body rotation control portion 3*b*1 which abuts on the boss 1*b* are provided on side plates of both sides of the apparatus main body 100A. Furthermore, a cartridge guide 3*a* that guides the boss 1*a* to the mounting portion 3*a*1 and a cartridge guide 3*b* that guides the boss 1*b* to the main body rotation control portion 3*b*1 are provided to the respective side plates. When the cartridge 1 is mounted into the apparatus main body 100A, the bosses 1*a* and 1*b* move along the cartridge guides 3*a* and 3*b* and abut the mounting portion 3*a*1 and the main body rotation control portion 3*b*1. Accordingly, a path and orientation of the cartridge 1 in the apparatus main body 100A are determined.

As illustrated in FIG. 2B, when the cartridge 1 is pushed forward into the apparatus main body 100A, the boss la abuts the mounting portion 3*a*1 provided at the end of the cartridge guide 3*a* and its position is determined. At that time, according to a spring member (not shown), a biasing force is applied to the boss 1*a* of the cartridge 1 in the direction toward the bottom of the apparatus main body 100A. Thus, unless a force that exceeds that the biasing force is applied to the cartridge 1, the cartridge 1 will not be out of position from the mounting position.

(Regulating Member)

Figure 3:
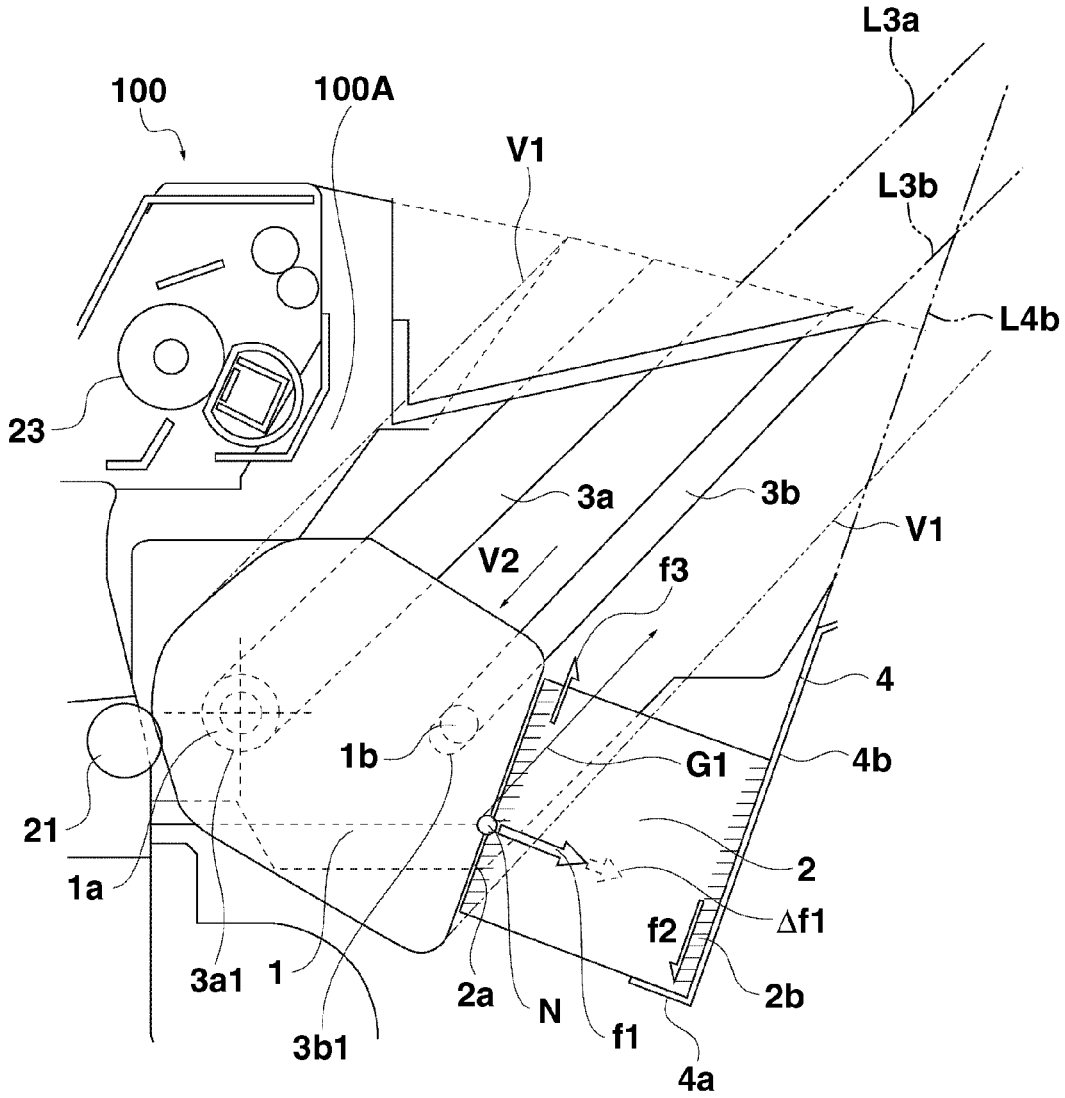
FIG. 3 is a cross-sectional view of the image forming apparatus according to a second exemplary embodiment of the present invention.

FIG. 3 is a cross-sectional view of the cartridge 1 when a regulating member 2 is mounted at the regulation position. The regulating member 2 is removable and controls the movement of the cartridge 1. The regulation position of the regulating member 2 is a position of the regulating member 2 determined by a main body regulating portion 4*a* and a side wall 4*b* of a main body frame 4. Further, the cross-sectional view in FIG. 3 illustrates a vertical plane of the cartridge 1 with respect to its longitudinal direction and the plane passes through the center of the main body as is with the cross-sectional view in FIG. 2. Further, the regulating member 2 is used only when the image forming apparatus 100 is transported and removed when the image forming apparatus 100 is used.

As illustrated in FIG. 3, the main body frame 4, which is one portion of the apparatus main body 100A, is provided at a position away from a mounting and dismounting path V1. The mounting and dismounting path V1 is a path that the cartridge 1 passes when the cartridge 1 is mounted into or dismounted from the apparatus main body 100A. Further, the regulating member 2 is mounted at the regulation position in such a manner that it fills a gap between the main body frame 4 and the cartridge 1. The regulating member 2 contacts the cartridge 1 at a contact surface 2*a* and contacts the side wall 4*b* which is a main body contact portion of the main body frame 4 at a contact surface 2*b*. The contact surface 2*a* is referred to as a first contact portion. The contact surface 2*b* is referred to as a second contact portion. Further, the contact surface 2*b* of the regulating member 2 is a surface parallel to the contact surface 2*a* down toward the main body frame 4.

As illustrated in FIG. 3, if a point on the contact surface 2*a* of the regulating member 2 is set as a point N, the point N receives a force G1 (a first force) in a direction parallel to the cartridge guides 3*a* and 3*b*, which are the first and the second cartridge guides respectively, when the cartridge 1 moves toward the upstream side in the mounting direction of the cartridge 1. The force G1 acts on the regulating member 2 inwardly regardless of the position of the point N so long as the point N is on the contact surface 2*a*. This is because an imaginary line L4*b*, which is a line of the side wall 4*b* of the main body frame 4 extended to the upstream side in the mounting direction of the cartridge 1, is set at such an angle that it intersects with imaginary lines L3*a* and L3*b*, which are lines of the cartridge guides 3*a* and 3*b* extended to the upstream side in the mounting direction of the cartridge 1.

In other words, if the cartridge 1 tends to move in a cartridge-dismounting direction (the cartridge 1 removing direction) from the mounting portion 3*a*1 due to impact it has received during the transportation of the image forming apparatus 100, then, as illustrated in FIG. 3, the cartridge 1 moves in such a direction that the cartridge presses the regulating member 2. At that time, as described above, the point N on the contact surface 2*a* receives the force G1. Then, a pressing force f1 perpendicular to the main body frame 4 is applied to the regulating member 2.

Similarly, a force is added to the regulating member 2 due to impact when the apparatus is transported. However, since the regulating member 2 is made from a light-weight material such as expanded polystyrene, the impact on the regulating member 2 is far smaller than the force applied to the cartridge 1 and therefore can be ignored. This applies to second, third, and fourth exemplary embodiments described below.

The pressing force f1 is transmitted in the vertical direction with respect to the contact surface 2*a* to the regulating member 2 and is received by the main body frame 4 at the contact surface 2*b*. Since the contact surface 2*b* is the surface parallel to the contact surface 2*a*, rotation moment due to the pressing force f1 is not generated on the regulating member 2. Further, since the main body frame 4 is made from a highly rigid component, it is not deformed. Thus, the regulating member 2 is pressed against the main body frame 4 by the pressing force f1.

Then, a frictional force (second force) due to friction between the regulating member 2 and the main body frame 4 acts on the regulating member 2 in the vertical direction according to the pressing force f1. The frictional force f2 regulate the movement of the regulating member 2 toward the upstream side in the mounting direction from the regulation position. In other words, the frictional force f2 is a force that moves the regulating member 2 to the downstream side in the mounting direction of the regulating member 2. Further, the regulating member 2 contacts the main body regulating portion 4*a* provided on the main body frame 4 and the regulating member 2 is prevented from moving to the downstream side in the mounting direction.

As described above, the cartridge guides 3*a* and 3*b* are not in parallel with the main body frame 4 and provided at such an angle that they intersect with the main body frame 4 at the upstream side in a mounting direction V2 of the cartridge 1. In other words, the angle of the main body frame 4 with respect to the horizontal direction is greater than the angle of the cartridge guides 3*a* and 3*b* with respect to the horizontal direction.

Thus, if the cartridge 1 moves in such a direction that it is removed from the mounting portion 3*a*1, the regulating member 2 is pressed by the cartridge 1. Accordingly, in addition to the pressing force f1, an elastic force Δf1 due to deformation of the regulating member 2 is applied to the main body frame 4. As a result, the frictional force f2 due to the friction between the regulating member 2 and the main body frame 4 is further increased and will be sufficiently greater than a force f3 which is a component of the force G1 (shown by the arrow) and is parallel to the main body frame 4. Thus, the regulating member 2 does not move from the regulation position and can control the cartridge 1 not to move from the mounting position.

Further, the regulating member 2 is mounted into a position which can be visually recognized from outside of the apparatus main body 100A when the inside of the apparatus main body 100A is viewed from the opening 100A1. The positional configuration of the regulating member 2 is such that, as illustrated in FIG. 2A, the imaginary line L4*b*, which is the line of the side wall 4*b* of the main body frame 4 extended to the upstream side, passes the opening 100A1. In other words, when the regulating member 2 is mounted into the apparatus main body 100A, since there is no obstacle in the mounting path, the regulating member 2 can be easily removed.

If the image forming apparatus 100 is transported while the cartridge 1 is being mounted, the regulating member 2 receives a force from the main body frame 4 at a position away from the mounting and dismounting path V1 of the cartridge 1. This force prevents the regulating member 2 from moving from the regulation position. Thus, it is not necessary to secure the open/close cover 40 to the apparatus main body 100A so that the open/close cover 40 presses down the regulating member 2 or enhance the rigidity of the open/close cover 40. Further, in some cases, an optional unit, such as a scanner for reading a document, is provided on the open/close cover 40 and use of the packaging material affects the function of the open/close cover 40. The present exemplary embodiment is useful in controlling the movement of the cartridge 1 by the regulating member 2 under such conditions.

If the cartridge 1 is mounted such that it is inserted far into the apparatus main body 100A, it is not necessary to increase the size of the regulating member 2 and therefore contributes to reducing cost. Further, since the side wall 4*b* of the main body frame 4 that generates the frictional force f2 applied to the regulating member 2 is set at a position that can be viewed from the outside of the main body 100A via the opening 100A1, the regulating member 2 can be removed easily.

Next, an image forming apparatus 200 according to a second exemplary embodiment will be described with reference to FIGS. 4 and 5. The present exemplary embodiment is different from the first exemplary embodiment in that a cartridge 101 is rotated in an apparatus main body 200A before it is positioned in the apparatus main body 200A. Components similar to those in the first exemplary embodiment are denoted by the same reference numerals and their descriptions are not repeated.

(Image Forming Apparatus)

Figure 4A:
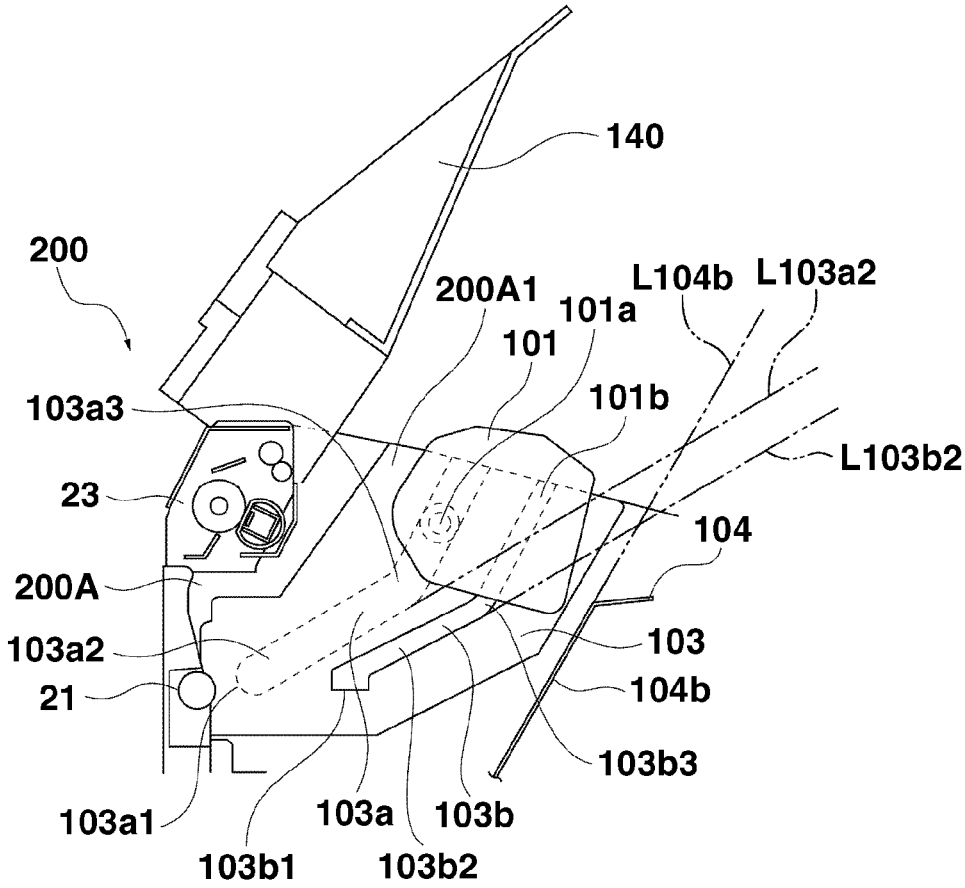
FIGS. 4A to 4C are cross-sectional views of the image forming apparatus according to the second exemplary embodiment of the present invention.
Figure 4B:
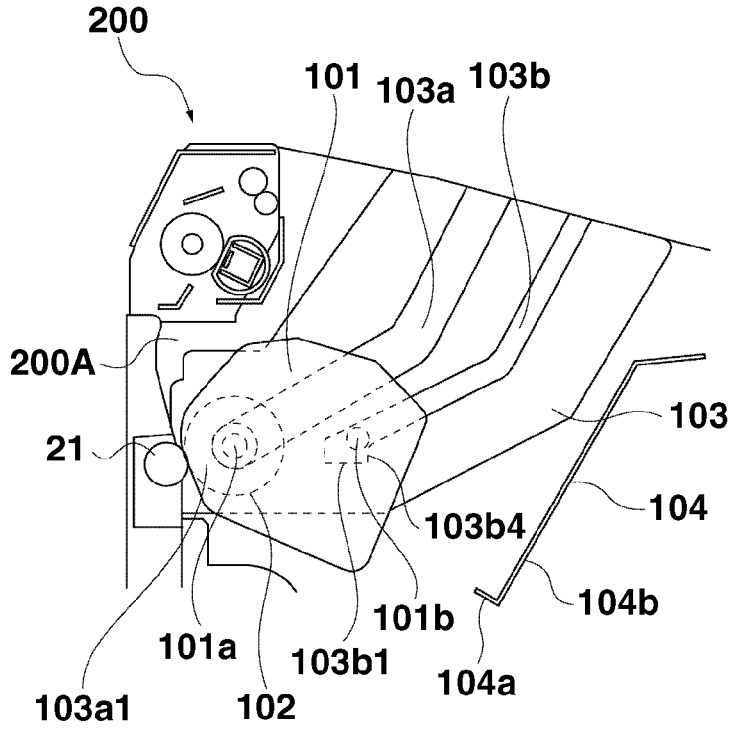
Figure 4C:
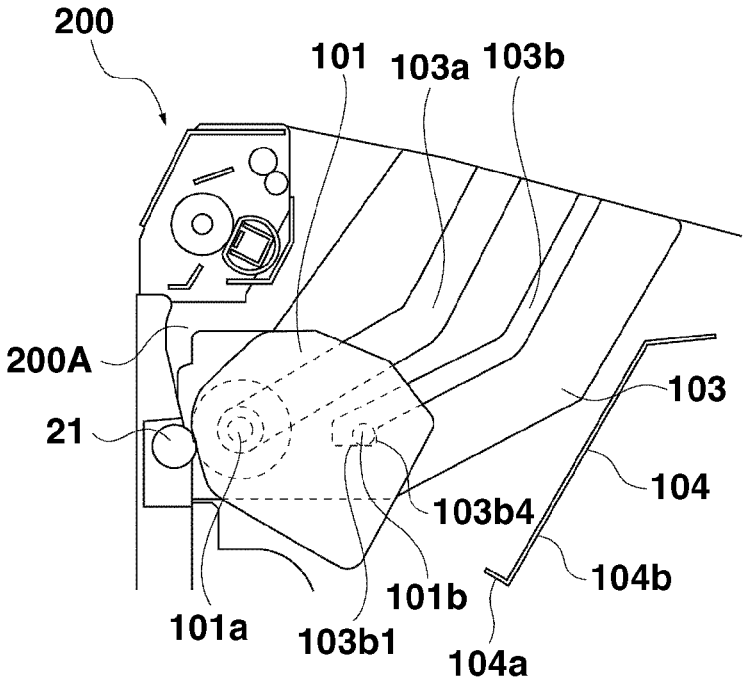

FIGS. 4A to 4C are cross-sectional views of the cartridge 101 in the vicinity of its mounting portion taken from the left side of the apparatus main body 200A. In FIGS. 4A to 4C, the cartridge 101 is viewed from the longitudinal direction thereof. FIG. 4A illustrates a state when the mounting of the cartridge 101 into the apparatus main body 200A is started. FIG. 4B illustrates a state just before the mounting of the cartridge 101 into the apparatus main body 100A is completed. FIG. 4C illustrates a state when the mounting of the cartridge 101 into the apparatus main body 100A is completed.

As illustrated in FIG. 4A, in mounting or dismounting the cartridge 101 into or from the apparatus main body 200A, an open/close cover 140 is moved obliquely upward so that an opening 200A1 of the apparatus main body 200A is opened. Then, the cartridge 101 is inserted into the apparatus main body 200A from the opening 200A1. A boss 101*a* and a boss 101*b* are provided on both ends of the cartridge 101 in the longitudinal direction. The boss 101*a* is a positioning member used for determining the orientation of the cartridge 101 in the apparatus main body 200A. The boss 101*b* is a rotation control member. Further, amounting portion 103*a*1 which engages with the boss 101*a* and a main body rotation control portion 103*b*1 which abuts on the boss 101*b* are provided on side plates of both sides of the apparatus main body 200A. Furthermore, a first cartridge guide 103*a* that guides the boss 101*a* to the mounting portion 103*a*1 and a second cartridge guide 103*b* that guides the boss 101*b* to the main body rotation control portion 103*b*1 are provided to the respective side plates.

When the cartridge 101 is mounted into the apparatus main body 200A, the bosses 101*a* and 101*b* move along the first and the second cartridge guides 103*a* and 103*b*. According to the present exemplary embodiment, the first and the second cartridge guides 103*a* and 103*b* are bent in the middle. Thus, with respect to the mounting direction of the cartridge 101, the first cartridge guide 103*a* includes an upstream portion 103*a*3 and a downstream portion 103*a*2, and the second cartridge guide 103*b* includes an upstream portion 103*b*3 and a downstream portion 103*b*2. The upstream portions 103*a*3 and 103*b*3 have greater angles with respect to the horizontal direction compared to the angles of the downstream portions 103*a*2 and 103*b*2. This aims at reducing the size of the apparatus main body 200A by increasing the angles of the upstream portions 103*a*3 and 103*b*3 and reducing the dead space of the apparatus main body 200A.

As illustrated in FIG. 4B, when the cartridge 101 is pushed forward into the apparatus main body 200A, first, the boss 101*a* abuts the mounting portion 103*a*1. At this time, a gap is made between the boss 101*b* and the main body rotation control portion 103*b*1. Thus, the cartridge 101 can rotate about the boss 101*a* in such a direction that the boss 101*b* contacts the main body rotation control portion 103*b*1.

Then, the cartridge 101 rotates from the state illustrated in FIG. 4B and is positioned at where the boss 101*b* contacts the main body rotation control portion 103*b*1 as illustrated in FIG. 4C. At that time, according to a spring member (not shown), a biasing force is applied to the boss 101*a* of the cartridge 101 in the direction toward the bottom of the apparatus main body. Thus, unless a force that exceeds the biasing force is applied to the cartridge 101, the cartridge 101 will not be out of position from the mounting portion 103*a*1.

Since a photosensitive member 102 of the cartridge 101 is pressed against the transfer roller 21, the cartridge 101 receives a force from the transfer roller 21 from an approximately horizontal direction. The boss 101*b* of the cartridge 101 receives the force since the boss 101*b* contacts a wall 103*b*4 of the second cartridge guide 103*b*.

(Regulating Member)

FIGS. 5A to 5D are cross-sectional views of the cartridge 101 when a regulating member 102 is mounted at the regulation position. The regulating member 102 is removable and controls the movement of the cartridge 101. Each of the cross-sectional views in FIGS. 5A to 5D illustrates a vertical plane passing through the center of the main body with respect to the longitudinal direction of the cartridge 101 as is with the cross-sectional view in FIG. 4. Further, the regulating member 102 is used only when the image forming apparatus 200 is transported and removed when a user uses the image forming apparatus 200.

Figure 5A:
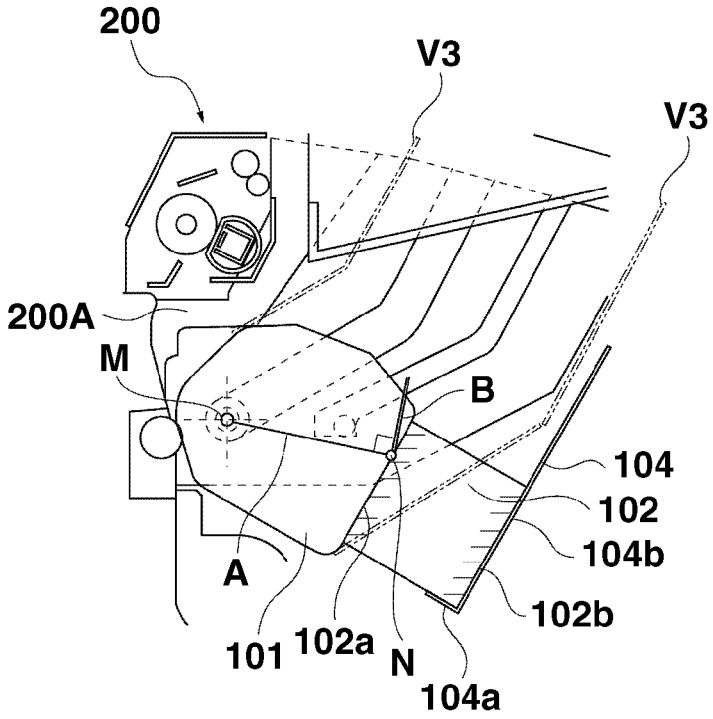
FIGS. 5A to 5D are cross-sectional views of the image forming apparatus according to the second exemplary embodiment of the present invention.

As illustrated in FIG. 5A, the main body frame 104, which is one portion of the apparatus main body 200A, is provided at a position away from a mounting and dismounting path V3. The mounting and dismounting path V3 is a path that the cartridge 101 passes when the cartridge 101 is mounted into or dismounted from the apparatus main body 200A. Further, the regulating member 102 is set at the regulation position in such a manner that it fills a gap between the main body frame 104 and the cartridge 101. The regulation position is where the position of the regulating member 102 is determined by a side wall 104*b* of the main body frame 104 and a main body regulating portion 104*a* which is a surface perpendicular to the side wall 104*b*.

The regulating member 102 contacts the cartridge 101 at a contact surface 102*a* and also contacts the side wall 104*b* which is a main body contact portion of the main body frame 104 at a contact surface 102*b*. The contact surface 102*b* is a second contact portion. Further, the contact surface 102*b* is a surface parallel to the contact surface 102*a* down toward the main body frame 104.

Figure 5B:
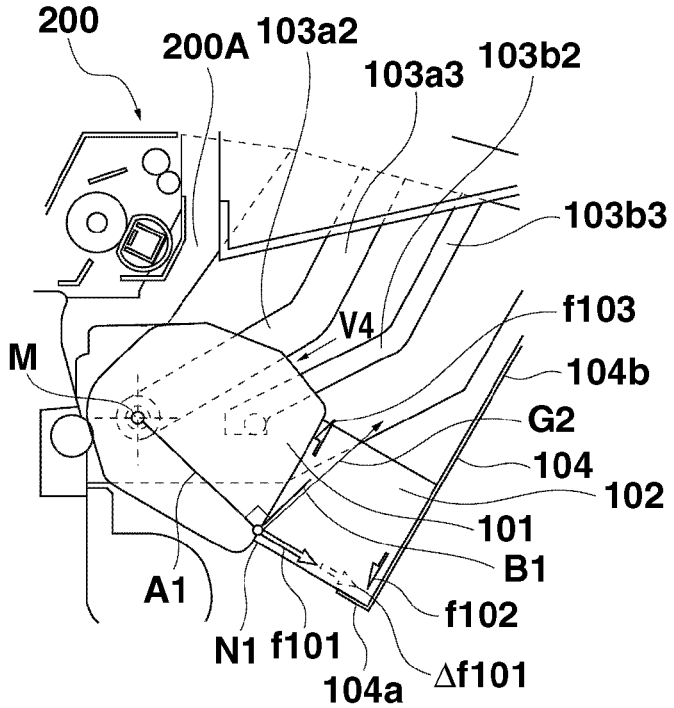
Figure 5C:
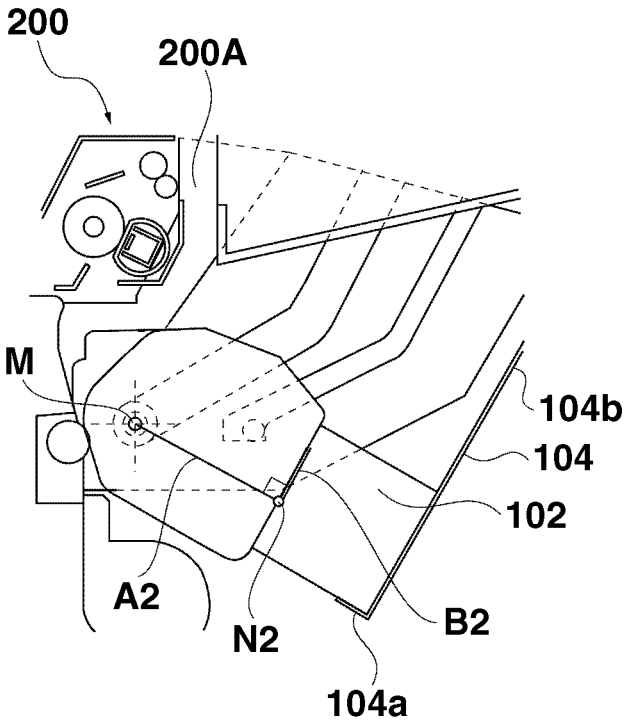
Figure 5D:
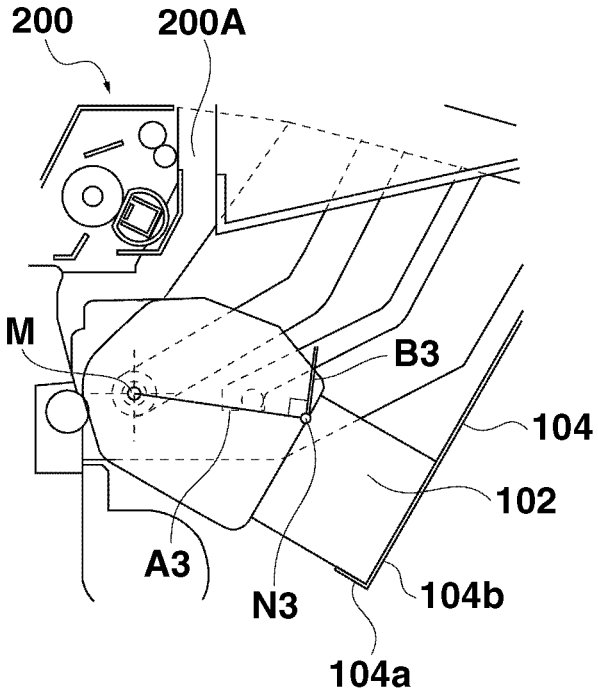

A center point of the boss 101*a* being the center of rotation of the cartridge 101 is referred to as a center point M and a point on the contact surface 102*a* of the regulating member 102 is referred to as a point N. Further, a line segment between the center point M and the point N is referred to as a line segment A. Furthermore, a line segment obtained by arbitrarily extending a perpendicular line of the line segment A from the point N in the rotatable direction of the cartridge 101 is referred to as a line segment B. As illustrated in FIGS. 5B to 5D, the point N in FIG. 5B is a point N1, the point N in FIG. 5C is a point N2, and the point N in FIG. 5D is a point N3. Further, line segments corresponding to the points N1, N2, and N3 are referred to as line segments A1, A2, A3, and B1, B2, and B3, respectively.

In FIG. 5C, the line segment B2 coincides with a tangential line of an outline of the regulating member 102 at the point N2. In FIG. 5D, the line segment B3 passes the outer side of the regulating member 102. In FIG. 5B, the line segment B1 passes the inner side of the regulating member 102. If the cartridge 101 is moved away from the mounting position due to impact, the cartridge 101 rotates about the boss 101*a* and the boss 101*b* needs to be separated from the main body rotation control portion 103*b*1. Thus, if the cartridge 101 rotates, as illustrated in FIG. 5B, the cartridge 101 moves in such a direction that it presses the regulating member 102 at the point N1 on the regulating member 102.

On the other hand, as illustrated in FIGS. 5B, 5C and 5D, the cartridge 101 does not move in such a direction that it presses the regulating member 102 with respect to the points N2 and N3. Thus, the regulating member 102 receives a force G2 (the first force) at only the point N1. Accordingly, the regulating member 102 includes the point N1 which is a first contact portion that receives the force G2 toward the inside of the regulating member 102 from the cartridge 101 when the cartridge 101 is moved away from the mounting position. Further, as for a perpendicular component with respect to the main body frame 104, the regulating member 102 receives a pressing force f101.

The pressing force f101 is transmitted through the regulating member 102 and received by the main body frame 104 at the contact surface 102*b*. Since the contact surface 102*b* is the surface parallel to the contact surface 102*a*, rotation moment due to the pressing force f101 is not generated with respect to the regulating member 102. Further, since the main body frame 104 is made from a highly-rigid material, it is not deformed. In other words, the regulating member 102 is pressed against the main body frame 104 by the pressing force f101. Further, due to the pressing force f101, a frictional force f102 (a second force) acts on the regulating member 102. The frictional force f102 is friction between the regulating member 102 and the main body frame 104 in the vertical direction. This frictional force f102 is a control force that prevents the regulating member 102 from moving from the regulation position.

The downstream portions 103*a*2 and 103*b*2 of the first and the second cartridge guides 103*a* and 103*b* are not in parallel with the main body frame 104 and provided at such an angle that they intersect with the main body frame 104 at the upstream side in a mounting direction V4 of the cartridge 101. In other words, the angle of the main body frame 104 with respect to the horizontal direction is greater than the angle of the cartridge guides 103*a* and 103*b* with respect to the horizontal direction. Furthermore, as illustrated in FIG. 4A, the first and the second cartridge guides 103*a* and 103*b* are set at such an angle that imaginary lines L103*a*2 and L103*b*2, which are lines of the downstream portions 103*a*2 and 103*b*2 extended to the upstream side in the mounting direction V4, intersect with an imaginary line L104*b* which is obtained by extending the side wall 104*b* to the upstream side in the mounting direction V4.

Thus, if the cartridge 101 moves in such a direction that it is removed from the mounting portion 103*a*1, the regulating member 102 is pressed by the cartridge 101. Accordingly, in addition to the pressing force f101, an elastic force Δf101 due to deformation of the regulating member 102 is applied to the main body frame 104.

Thus, the frictional force f102 due to the friction between the regulating member 102 and the main body frame 104 is further increased and becomes sufficiently greater than a force f103 which is a component of the force G2 (shown by the arrow) and is parallel to the main body frame 104. Thus, the regulating member 102 does not move from the regulation position and thus can control the movement of the cartridge 101. In other words, the frictional force f102 is a force that acts on the regulating member 102 so that the regulating member 102 moves to the downstream side in the mounting direction thereof. Further, since the regulating member 102 contacts the main body regulating portion 104*a* of the main body frame 104, the movement of the regulating member 102 to the downstream side in the mounting direction is controlled.

Further, the regulating member 102 is mounted into a position which can be visually recognized from outside of the apparatus main body 200A when the inside of the apparatus main body 200A is viewed from the opening 200A1. The positional configuration of the regulating member 102 is such that, as illustrated in FIG. 4A, the imaginary line L104*b*, which is the line of the side wall 104*b* of the main body frame 104 extended to the upstream side, passes the opening 200A1. In other words, when the regulating member 102 is mounted into the apparatus main body 200A, since there is no obstacle in the mounting path, the regulating member 102 can be easily removed.

As described above, if the image forming apparatus 200 is transported while the cartridge 101 is being mounted, the regulating member 102 receives a force from the main body frame 104 at a position away from the mounting and dismounting path V3 of the cartridge 101. This force prevents the regulating member 102 from moving from the regulation position. Thus, it is not necessary to secure the open/close cover 140 to the apparatus main body 200A so that the open/close cover 140 presses down the regulating member 102 or enhance the rigidity of the open/close cover 140.

Other effects are same as the first exemplary embodiment. Further, since the side wall 104*b* of the main body frame 104 that generates the frictional force f102 applied to the regulating member 102 is set at a position that can be viewed from the outside of the main body 200A via the opening 200A1, the regulating member 102 can be removed easily.

Next, an image forming apparatus 300 according to a third exemplary embodiment of the present invention will be described with reference to FIG. 6. The present exemplary embodiment differs from the first and the second exemplary embodiments in that contact surfaces 202*a* and 202*b* of a regulating member 202, which contact a cartridge 201 are not parallel to contact surfaces 202*c* and 202*d* which contact aside wall 204*b* that is a main body contact portion of a main body frame 204. Components similar to those in the first and the second exemplary embodiments are denoted by the same reference numerals and their descriptions are not repeated.

Figure 6A:
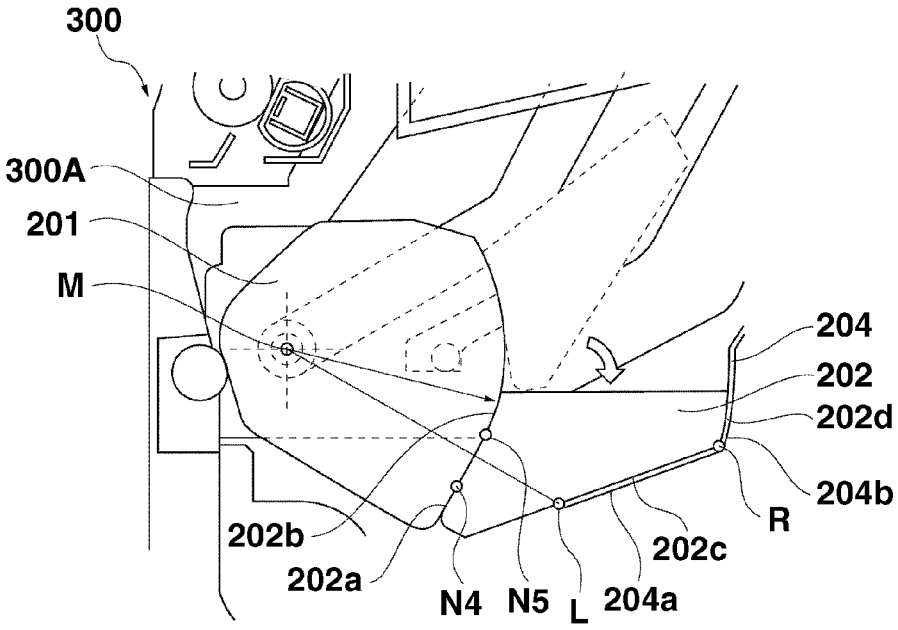
FIGS. 6A to 6C are cross-sectional views of the image forming apparatus according to a third exemplary embodiment of the present invention.
Figure 6B:
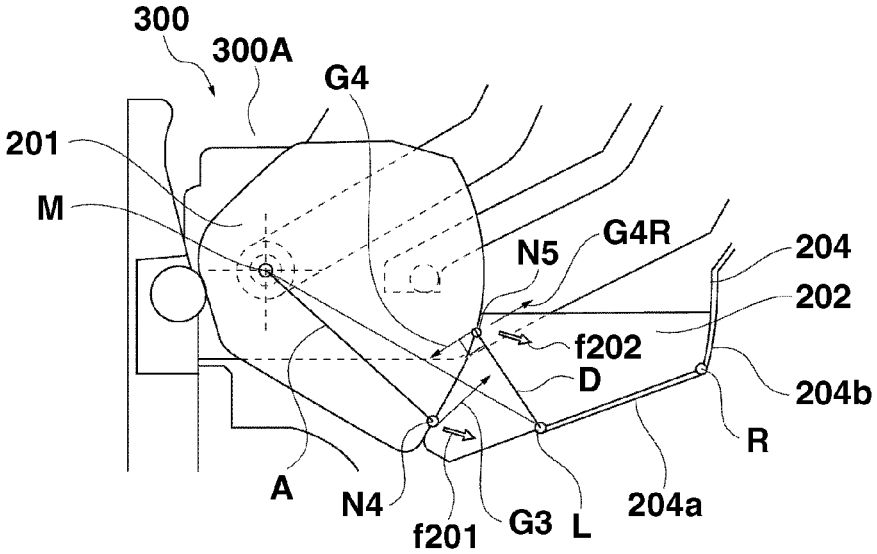
Figure 6C:
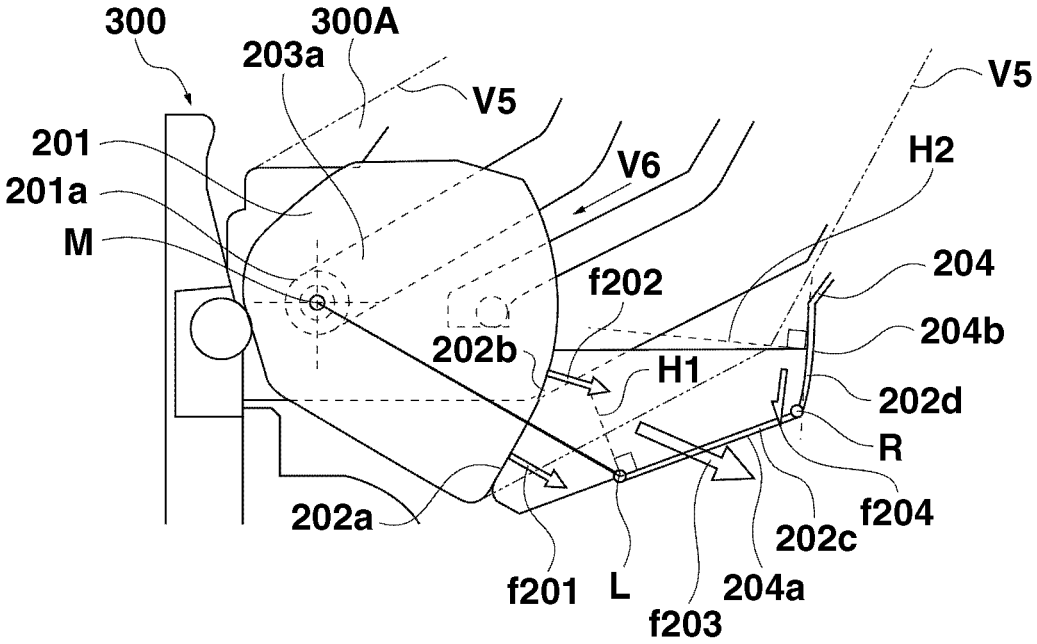

As illustrated in FIG. 6A to FIG. 6C, the configurations of the cartridge 201 and cartridge guides 203*a* and 203*b* are similar to the configurations of the components in the second exemplary embodiment.

As illustrated in FIG. 6A, the regulating member 202 which is removable includes the contact surfaces 202*a*, 202*b*, 202*c*, and 202*d*. The contact surface 202*d* has an arc shape having the center point M of a boss 201*a* of the cartridge 201 at the center of the arc and contacts the side wall 204*b* of the main body frame 204. The contact surface 202*c* of the regulating member 202 contacts a main body regulating portion 204*a* of the main body frame 204. Thus, the movement of the regulating member 202 toward the downstream side in the mounting direction is regulated.

In the following description, a point on the contact surface 202*a* is referred to as a point N4 and a point on the contact surface 202*b* is referred to as a point N5. Further, a point where the regulating member 202 contacts an end of the main body regulating portion 204*a* of the main body frame 204 in the mounting direction is referred to as a point L, and a point where the contact surfaces 202*c* and 202*d* contact is referred to as a point R. A contact point of the contact surfaces 202*a* and 202*b* is provided on a line segment that connects the center point M and the point L of the regulating member 202. As described above, the contact surface 202*d* has the arc shape having the center point M at the center of the curve. The mounting of the regulating member 202 is completed by rotating the regulating member 202 along the cartridge 201. The regulating member 202 is used only when the image forming apparatus 300 is transported and removed when a user uses the image forming apparatus 300.

As illustrated in FIGS. 6A and 6B, the contact surface 202*a* can has a range in which a line segment B in FIG. 6B can be set at the point N4 which pass the inside of the regulating member 202. In other words, with respect to the contact surface 202*a*, the regulating member 202 receives a force G3 (the first force) at the point N4 from the cartridge 201 in such a direction that the regulating member 202 is pressed. Since a pressing force f201 of a component perpendicular to a tangential component of the contact surface 202*a* acts on the regulating member 202, turning moment about the point L in the counterclockwise direction is produced. Accordingly, if a line segment that connects the points L and N5 is referred to as a line segment D, a force shown by an arrow G4 acts on the cartridge 201 from the point N5 in the counterclockwise direction from a perpendicular line of the line segment D.

Then, a force G4R (the first force) as a reaction force of the force G4 acts on the regulating member 202. If the cartridge 201 rotates about the center point L according to a force f201, the contact surface 202*b* of the regulating member 202 is pressed against the cartridge 201. Further, a pressing force f202 which is a force of a component perpendicular to a tangential component of the contact surface 202*b* of the force G4R acts on the regulating member 202. As a result, as illustrated in FIG. 6C, the regulating member 202 receives a resultant force f203 of the forces f201 and f202 from the cartridge 201. The direction of the resultant force f203 is closer to the direction toward the point R with respect to perpendicular lines H1 and H2 of the contact surfaces 202*c* and 202*d*. Thus, according to the resultant force f203, the regulating member 202 is not moved.

In other words, the contact surfaces 202*a* and 202*b* (first contact portions) receive a resultant force f203 (the first force) from the cartridge 201. Thus, the contact surfaces 202*c* and 202*d* (second contact portions) receive a force f204 (the second force) in a direction that the regulating member 202 is controlled at the regulation position where the position of the contact surface 202*c* contacts the main body regulating portion 204*a*. Further, similar to the other exemplary embodiments, the force f204 acts on the regulating member 202 at a position away from a mounting and dismounting path V5 of the regulating member 202. Thus, the position regulation of the cartridge 201 can be performed and the cartridge 201 will be at the mounting position even when the image forming apparatus 300 is transported.

Figure 7:
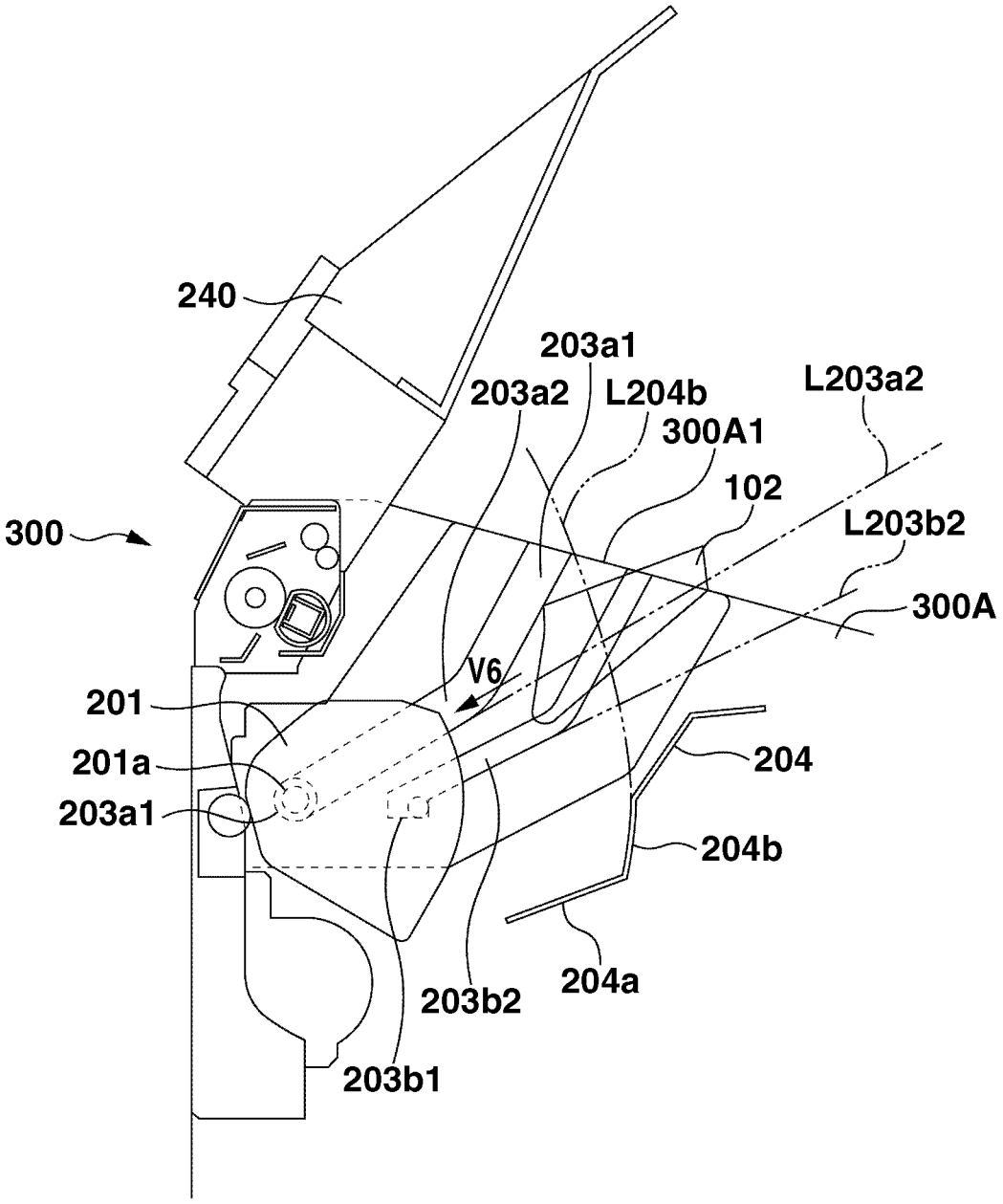
FIG. 7 is a cross-sectional view of the image forming apparatus according to the third exemplary embodiment of the present invention.

As illustrated in FIG. 7, the downstream portions 203*a*2 and 203*b*2 of the first and the second cartridge guides 203*a* and 203*b* are not in parallel with the main body frame 204 and provided at such an angle that they intersect with the main body frame 204 at the upstream side in a mounting direction V6 of the cartridge 201. In other words, the angle of the main body frame 204 with respect to the horizontal direction is greater than the angle of the downstream portions 203*a*2 and 203*b*2 with respect to the horizontal direction. Further, the first and the second cartridge guides 203*a* and 203*b* are set at such an angle that imaginary lines L203*a*2 and L203*b*2, which are lines of the downstream portions 203*a*2 and 203*b*2 extended to the upstream side in the mounting direction V6, intersect with an imaginary line L204*b* which is obtained by extending the side wall 204*b* to the upstream side in the mounting direction V6.

Similar to the first and the second exemplary embodiments, the force f204 is a force that moves the regulating member 202 to the downstream side in the mounting direction. Thus, the main body regulating portion 204*a* that controls the movement of the regulating member 202 so that it does not move to the downstream side in the mounting direction is provided on the main body frame 204.

Further, the regulating member 202 is mounted into a position which can be visually recognized from outside of the apparatus main body 300A when the inside of the apparatus main body 300A is viewed from an opening 300A1. The positional configuration of the regulating member 202 is such that, as illustrated in FIG. 7, the imaginary line L204*b*, which is the line of the side wall 204*b* of the main body frame 204 extended to the upstream side, passes the opening 300A1. In other words, when the regulating member 202 is mounted into the apparatus main body 300A, since there is no obstacle in the mounting path, the regulating member 202 can be easily removed.

As described above, if the image forming apparatus 300 which can be transported while the cartridge 201 is being mounted is transported, the regulating member 202 receives a force from the main body frame 204 at a position away from the mounting and dismounting path V5 of the cartridge 201. This force prevents the regulating member 202 from moving from the regulation position. Thus, it is not necessary to secure the open/close cover 240 to the apparatus main body 300A so that the open/close cover 240 presses down the regulating member 202 or enhance the rigidity of the open/close cover 240. Further, since the side wall 204*b* of the main body frame 204 is set at a position that can be viewed from the outside of the main body 300A via the opening 300A1, the regulating member 202 can be easily removed.

Figure 8:
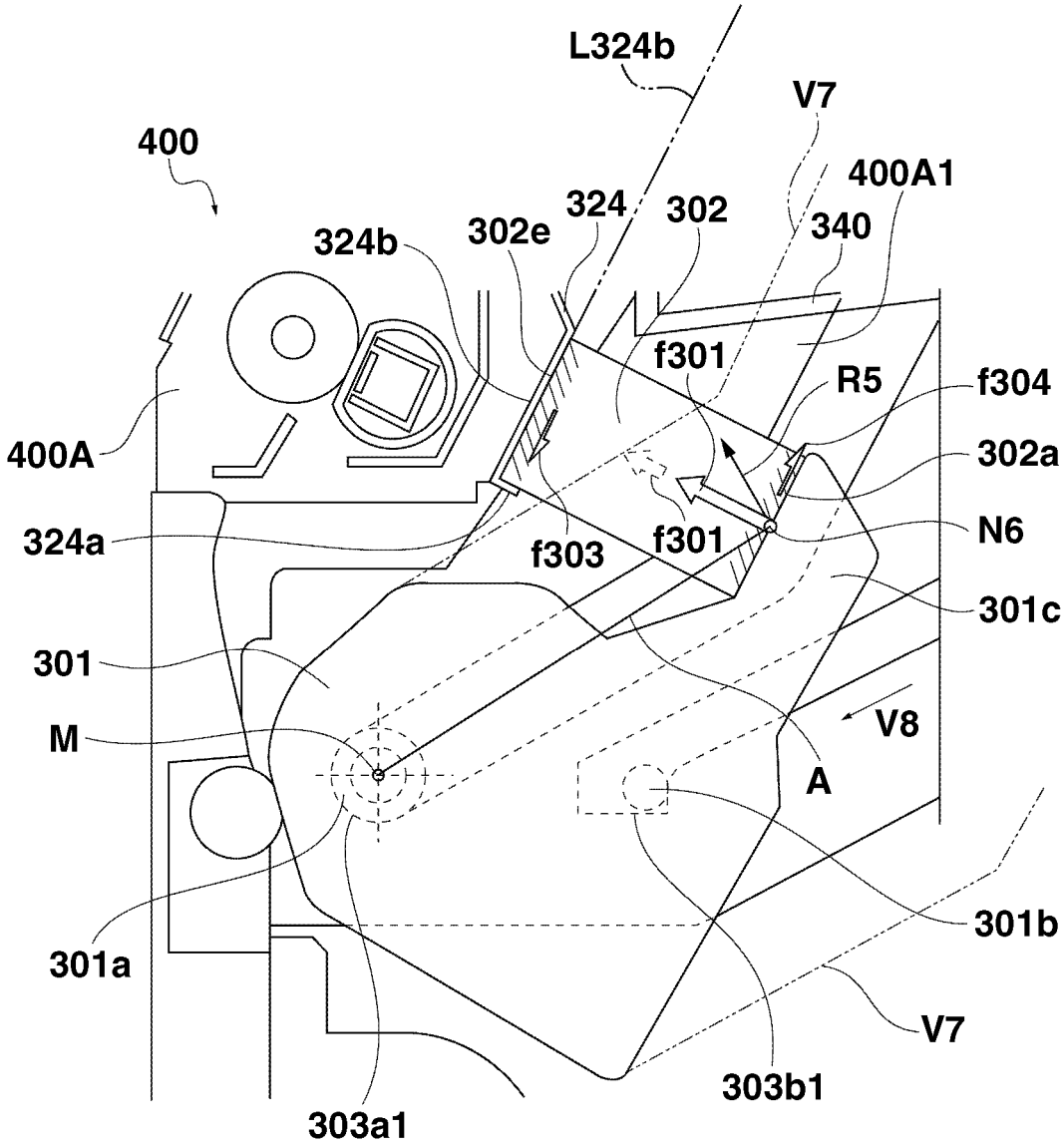
FIG. 8 is a cross-sectional view of the image forming apparatus according to a fourth exemplary embodiment of the present invention.

Next, an image forming apparatus 400 according to a fourth exemplary embodiment will be described with reference to FIG. 8. FIG. 8 is a cross-sectional view of a portion of the cartridge 301 in the vicinity of its mounting portion taken from the left side of an apparatus main body 400A. The cross section illustrates a vertical plane passing through the center of the main body with respect to the longitudinal direction of the cartridge 301. Descriptions and illustrations of components similar to those in the first to the third exemplary embodiments are not repeated. As illustrated in FIG. 8, configurations of cartridge guides 303*a* and 303*b* are similar to those in the second exemplary embodiment. In other words, in removing the cartridge 301 from a mounting position 303*a*1, the cartridge 301 rotates counterclockwise about a boss 301*a* so that a boss 301*b* is removed from a main body rotation control portion 303*b*1. Then, the cartridge 301 is moved to the upstream side in the mounting direction.

As illustrated in FIG. 8, the cartridge 301 includes a grip portion 301*c* which is a protrusion portion that extends in the direction of an open/close cover 340 when the cartridge is mounted. A user can hold the grip portion 301*c* when the user mounts and dismounts or carries the cartridge. A regulating member 302 which is removable contacts the grip portion 301*c* and also contacts a side wall 324*b* of a fixing frame 324 which is the main body frame. A contact surface 302*e* of the regulating member 302 that contacts the fixing frame 324 is parallel to a contact surface 302*a* in the vertical direction. The regulating member 302 is used only when the image forming apparatus 400 is transported and removed when the user uses the image forming apparatus 400.

In FIG. 8, on a point N6 on the contact surface 302*a*, the regulating member 302 receives a force R5 that presses the regulating member 302 on the contact surface 302*a* when the cartridge 301 rotates. According to the force R5, a force f301 which is a force of a component perpendicular to the fixing frame 324 is generated at the regulating member 302 and acts on the fixing frame 324. Then, according to the friction between the regulating member 302 and the fixing frame 324, the regulating member 302 is prevented from moving to the upstream side in the mounting direction.

Further, since the cartridge 301 needs to rotate about the boss 301*a*, the regulating member 302 flexes and the force Δf301 is excessively applied to the fixing frame 324. Thus, a frictional force f303 that acts on the regulating member 302 according to the fixing frame 324 increases and is greater than a force f304 to the upstream side in the mounting direction. So that the movement of the regulating member 302 and the cartridge 301 are prevented. Similar to the other exemplary embodiments, the frictional force f303 acts on the regulating member 302 at a position away from a mounting and dismounting path V7 of the cartridge 301.

Greater rotation moment that regulates the movement of the cartridge 301 is obtained and thus greater regulating force is obtained by increasing the distance between the position of the regulating member 302 and the center point M. In order to downsize the apparatus main body 400A, it is necessary to make the cartridge 301 smaller. However, in that case, the distance from the center point M to the regulating member will be reduced. Since the grip portion 301*c* of the cartridge 301 has a protruded shape and is held by the user, its size is greater than a certain size. Thus, a long distance between a point on the surface of the grip portion 301*c* and the center point M can be obtained, and thus advantageous in controlling the movement of the cartridge.

Further, if the contact surface 302*a* is closer to parallel with the line segment A in FIG. 8, an amount of penetration of the cartridge 301 to the regulating member 302 will be increased when the cartridge 301 rotates. Thus, the force f301 can be increased. Since the shape of the grip portion 301*c* can be changed rather flexibly regardless of component arrangement in the cartridge 301, the contact surface 302*a* can be designed so that it is close to parallel with the line segment A, and a greater regulating force can be obtained.

As a result, according to the grip portion 301*c*, usability with respect to mounting or dismounting the cartridge on or from the apparatus main body 400A and convenience of carrying is improved and the regulating force that acts on the movement of the cartridge 301 when the apparatus main body 400A receives impact when it is transported while the cartridge 301 is mounted can be increased.

Further, the force f303 can be considered as a force that moves the regulating member 302 to the downstream side in the mounting direction. Thus, a main body regulating portion 324*a* that prevents the regulating member 302 from moving toward the downstream side in the mounting direction is provided on the fixing frame 324.

Further, the regulating member 302 is mounted into a position which can be visually recognized from outside of the apparatus main body 400A when the inside of the apparatus main body 400A is viewed from an opening 400A1. The positional configuration of the regulating member 302 is such that, as illustrated in FIG. 8, the imaginary line L324*b*, which is the line of the side wall 324*b* of the fixing frame 324 extended to the upstream side, passes the opening 400A1. In other words, when the regulating member 302 is mounted into the apparatus main body 400A, since there is no obstacle in the mounting path, the regulating member 302 can be easily removed.

As described above, if the image forming apparatus 400 which can be transported while the cartridge 301 is being mounted is transported, the regulating member 302 receives a force from the fixing frame 324 at a position away from the mounting and dismounting path V7 of the cartridge 301. This force prevents the regulating member 302 from moving from the regulation position. Thus, it is not necessary to secure the open/close cover 340 to the apparatus main body 400A so that the open/close cover 340 presses down the regulating member 302 or enhance the rigidity of the open/close cover 340. Other effects are similar to those of the first to the third exemplary embodiments. Further, since a side wall 324*b* of a main body frame 324 is set at a position that can be viewed from the outside of the main body 400A via the opening 400A1, the regulating member 302 can be easily removed.

As described above, according to the present invention, the impact caused by the cartridge when the image forming apparatus is transported is received by the rigid frame in the apparatus main body via the regulating member, and thus it is not necessary to depend on the open/close cover. Thus, the regulating member can be made smaller and the movement of the cartridge can be stably controlled without increasing the rigidity of the open/close cover, adding a lock mechanism to the cover, or increasing the strength of the packaging material.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-005835 filed Jan. 14, 2010 and No. 2010-281047 filed Dec. 16, 2010, which are hereby incorporated by reference herein in their entirety.

What is claimed is:

1. An image forming apparatus which can be transported with a cartridge mounted, the image forming apparatus comprising:

a mounting portion on which the cartridge is removably mounted;

a regulating member configured to regulate movement of the cartridge from the mounting portion and mounted between the cartridge and an apparatus main body of the image forming apparatus, wherein the regulating member includes a first contact portion which receives a first force applied from the cartridge to inside of the regulating member if the cartridge moves from the mounting portion and a second contact portion which receives a second force that prevents the regulating member from moving to an upstream side in a mounting direction of the regulating member at a position away from a mounting and dismounting path of the cartridge where the cartridge passes when the cartridge is mounted on or dismounted from the apparatus main body by receiving the first force; and a main body regulating portion configured to regulate movement of the regulating member to a downstream side in the mounting direction by the second force and brought into contact with the regulating member.

2. The image forming apparatus according to claim 1, wherein the cartridge includes a positioning portion whose position is determined by the mounting portion and a rotation regulating portion configured to prevent the cartridge from rotating about the positioning portion, and contacts a main body rotation control portion provided in the apparatus main body, and wherein a line segment perpendicular to the first contact portion with respect to a line segment connecting the positioning portion and the first contact portion passes inside the regulating member.

3. The image forming apparatus according to claim 2, further comprising:

a first guide configured to guide the positioning portion to the mounting portion; and a second guide configured to guide the rotation regulating portion to the rotation regulating portion.

4. The image forming apparatus according to claim 3, wherein an imaginary line obtained by extending a main body contact portion provided on the apparatus main body to which the second contact portion contacts to the upstream side of the mounting direction of the cartridge intersects an imaginary line obtained by extending the first guide and the second guide to the upstream side of the mounting direction.

5. The image forming apparatus according to claim 2, wherein if the cartridge is removed from the mounting portion, after the cartridge is rotated about the positioning portion whose position is determined by the mounting portion, the positioning portion is separated from the mounting portion.

6. The image forming apparatus according to claim 2, wherein the cartridge includes a grip portion which is held when the cartridge is mounted on or dismounted from the apparatus main body and the grip portion is provided on the first contact portion.

7. The image forming apparatus according to claim 1, wherein the cartridge is a process cartridge including a photosensitive unit and a processing unit which acts on the photosensitive unit.

8. An image forming apparatus which can be transported with a cartridge mounted, the image forming apparatus comprising:

a mounting portion on which the cartridge is removably mounted;

an opening through which the cartridge passes when the cartridge is mounted onto the mounting portion;

a regulating member configured to regulate movement of the cartridge from the mounting portion and mounted between the cartridge and an apparatus main body of the image forming apparatus, wherein the regulating member includes a first contact portion which receives a first force applied from the cartridge to inside of the regulating member if the cartridge moves from the mounting portion and a second contact portion which receives a second force that prevents the regulating member from moving to an upstream side in a mounting direction of the regulating member at a position away from a mounting and dismounting path of the cartridge where the cartridge passes when the cartridge is mounted on or dismounted from a main body contact portion provided to the apparatus main body by receiving the first force; and an imaginary line obtained by extending the main body contact portion to the upstream side in the mounting direction passes the opening.

9. The image forming apparatus according to claim 8, further comprising a main body regulating portion configured to regulate movement of the regulating member to a downstream side in the mounting direction by the second force and brought into contact with the regulating member.

10. The image forming apparatus according to claim 8, wherein if the cartridge is removed from the mounting portion, after the cartridge is rotated about the positioning portion whose position is determined by the mounting portion, the positioning portion is separated from the mounting portion.

11. The image forming apparatus according to claim 8, wherein the cartridge includes a grip portion which is held when the cartridge is mounted on or dismounted from the apparatus main body and the grip portion is provided on the first contact portion.

12. The image forming apparatus according to claim 8, wherein the cartridge is a process cartridge including a photosensitive unit and a processing unit which acts on the photosensitive unit.

* * * * *